United States Patent [19]

Watson

[11] 4,023,629

[45] May 17, 1977

[54] TOGGLE ACTUATED UNDERREAMER

[75] Inventor: David L. Watson, Fort Worth, Tex.

[73] Assignee: Watson, Incorporated, Fort Worth, Tex.

[22] Filed: June 25, 1976

[21] Appl. No.: 699,783

[52] U.S. Cl. ..... 175/285; 175/238; 175/396

[51] Int. Cl.² ..... E02D 17/148

[58] Field of Search ..... 175/285, 238, 396, 202; 294/69 R

[56] References Cited

UNITED STATES PATENTS

| | | | |
|---|---|---|---|
| 2,235,159 | 3/1941 | Litter | 175/285 |
| 3,513,920 | 5/1970 | Watson | 175/285 |

FOREIGN PATENTS OR APPLICATIONS

| | | | |
|---|---|---|---|
| 331,945 | 7/1930 | United Kingdom | 175/202 |

*Primary Examiner*—Ernest R. Purser
*Assistant Examiner*—William F. Pate, III
*Attorney, Agent, or Firm*—Richards, Harris & Medlock

[57] ABSTRACT

An underreamer includes a housing and a plurality of underreamer doors, each including a toggle mechanism for selectively extending and retracting the doors. Upon activation of the toggle mechanism thereby extending the doors, the doors are pivoted outwardly from the housing and the tops of the doors are simultaneously moved downwardly. In this manner the overall vertical height of an underreamer adapted to form a given diameter excavation may be substantially reduced.

13 Claims, 4 Drawing Figures

FIG. 1
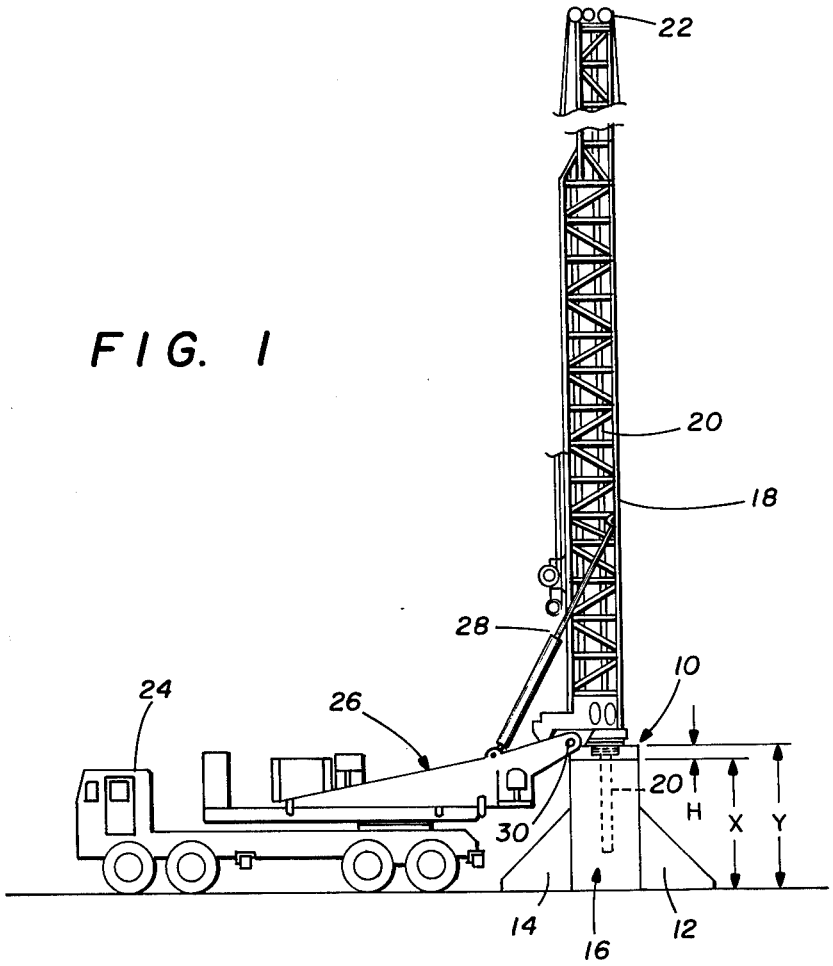
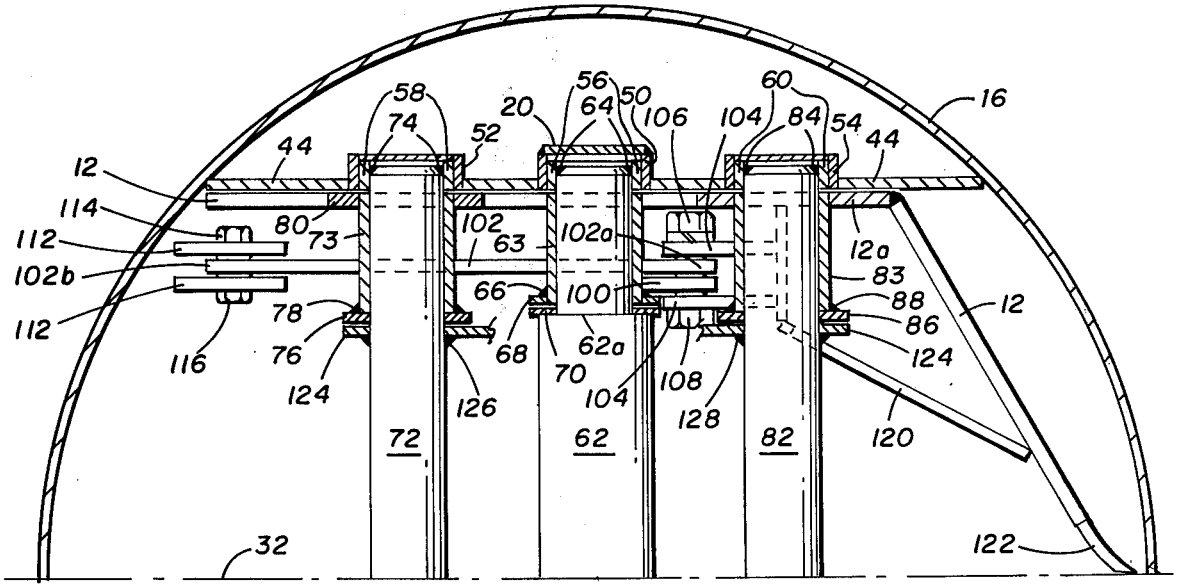
FIG. 3

TOGGLE ACTUATED UNDERREAMER

BACKGROUND AND SUMMARY OF THE INVENTION

This invention relates to an underreamer apparatus, and more particularly to an underreamer apparatus having a substantial reduction in vertical height.

An underreamer is a device utilized in the drilled shaft industry to form a bell or enlargement at the bottom of a drilled shaft. Shafts are typically formed utilizing a drilling rig, which actuates an auger to form the cylindrical hole or shaft. After the shaft is completed, the underreamer with its doors in the retracted position is inserted into the shaft and lowered to the bottom. The drilling rig then actuates the underreamer by rotating the underreamer and partially extending the doors outwardly from the underreamer housing to begin excavation of the bell. After an amount of material is excavated, the doors of the underreamer are then retracted into the housing to collect and retain the excavated material within the housing. The underreamer is then raised to the surface to remove the excavated material from the drilled shaft and deposit the material on the surface. This process is repeated, such that each time the underreamer is lowered to the shaft bottom the underreamer doors are extended a greater amount to further enlarge the bell until the doors are fully extended having excavated the bell to its maximum diameter.

Heretofore, a frequently encountered problem in the use of underreamers relates to the fact that the devices are typically quite tall in relation to their diameter. The underreamer height has been necessary in order to accommodate the mechanism of the underreamer which functions to extend the underreamer doors and thereby provide the desired excavating function. The excessive height of the underreamer leads to difficulty in utilizing the device under obstructions, and the like.

The present invention comprises a novel underreamer apparatus which overcomes the disadvantages that have characterized the prior art. Thus, the preferred emobodiment of the invention comprises an underreamer apparatus which includes a toggle mechanism that substantially reduces the vertical height of an underreamer necessary to form an excavation of a given diameter.

In accordance with the aspects of the invention, an underreamer apparatus for belling out a portion of an underground hole into a conical configuration includes a vertically elongated housing having an upper and lower portion and a plurality of underreamer doors each including a toggle machanism.

DESCRIPTION OF THE DRAWINGS

A more complete understanding of the invention may be had by referring to the following Detailed Description when taken in conjunction with the accompanying Drawings, wherein:

FIG. 1 is a side elevation view of the underreamer apparatus comprising the preferred embodiment of the present invention, shown connected to a drilling rig;

FIG. 3 is a sectional view taken generally along the sectional lines 3—3 of the underreamer apparatus of the present invention in FIG. 2; and FIG. 3 is a side elevation view, partly in section, of the underreamer apparatus of the invention showing the underreamer door in its extended position.

DETAILED DESCRIPTION

Figure 2:
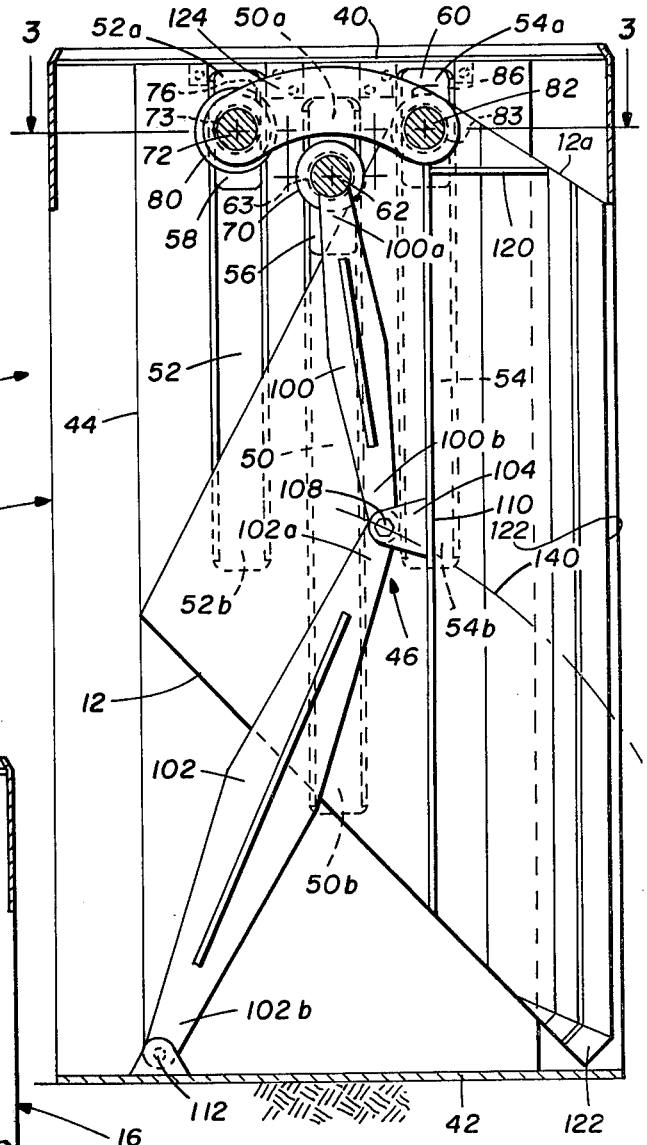
FIG. 2 is a side elevation view, partly in section, of the underreamer apparatus of the present invention.

Referring now the the Drawings, and particularly to FIG. 1 thereof, there is shown an underreamer assembly 10 incorporating the present invention. Underreamer assembly 10 includes underreamer doors 12 and 14, which are shown in the extended position. As will become more apparent hereinafter, the doors 12 and 14 are retractable into the underreamer housing 16 and are contained therein for insertion and retraction of the underreamer from a drilled shaft. Once inserted in the drilled shaft, the doors 12 and 14 are then swung outwardly of the housing 16 during use of the underreamer to bell out or enlarge the lower end of the drilled shaft.

Underreamer assembly 10 is mounted to a mast 18 using a kelly bar assembly 20. Kelly bar assembly 20 extends from within housing 16 to a crown block 22 at the upper end of mast 18. Mast 18 is supported by a vehicle 24, and in particular by the supporting structure 26. Mast 18 is movable from a vertical position, as shown in FIG. 1, to a horizontal-transport position above the body of vehicle 24 by operation of a hydraulic cylinder 28 pivotally rotating mast 18 about connection 30 at the lower end of mast 18.

Referring simultaneously to FIGS. 2 and 3, the underreamer assembly 10 shown in the door 12 in the retracted position. It being understood that door 14 is similarly contained within housing 16, but rotated approximately 180° , and is not shown for discussion purposes. Underreamer housing 16 includes an upper plate 40 and a lower plate 42. Plates 40 and 42 are interconnected by a frame 44, which supports the toggle mechanism 46, to be subsequently described.

Disposed within housing 16 and supported by frame 44 are a central guideway 50 and guideways 52 and 54, which are connected at their upper ends **50*a*, 52*a* and 54*a* to plate 40. Contained with guideway 50 is a spacer member 56, which is slidable between upper end 50*a* and lower end 50*b* of guideway 50. Similarly, guideway 52 includes a spacer member 58 and guideway 54 includes a spacer member 60**.

Figure 4:
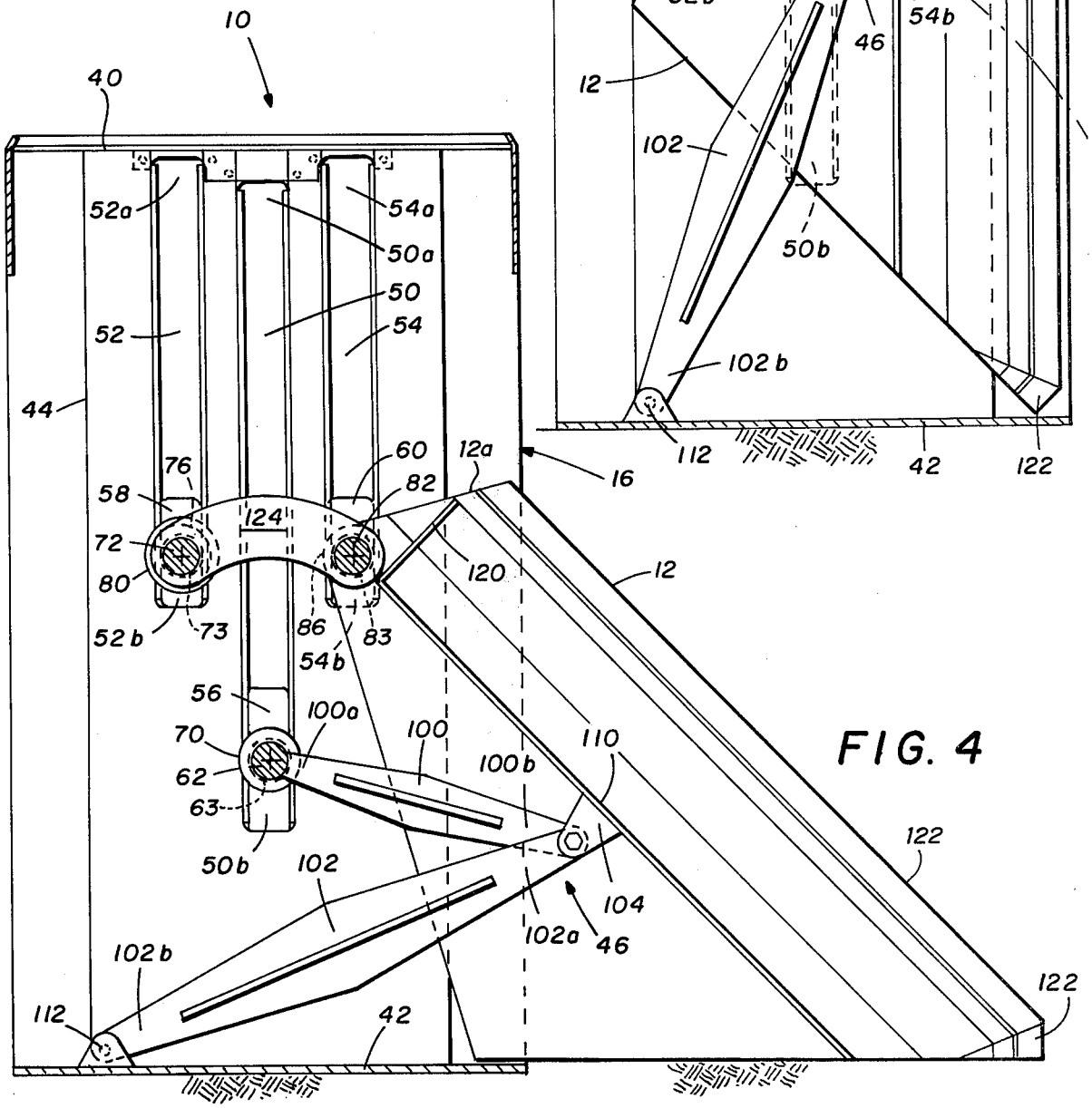

Spacer member 56 supports an end of central shaft 62, it being understood that the end of shaft 62 not shown is similarly supported in a spacer member and guideway comprising the half of the underreamer assembly 10 not shown in FIGS. 2, 3 and 4. Shaft 62 includes a shaft bushing 63, which is welded as at 66 to a thrust plate 68. Shaft 62 is welded to spacermember 56 as at 64. A thrust washer 70 is positioned between shoulder **62*a* of shaft 62 and thrust plate 68. An upper shaft 72 includes a shaft bushing 73, which is welded as at 78 to a thrust plate 76. The upper shaft 72 is supported by spacer member 58, which is welded to the upper shaft 72 as at 74. A second upper shaft 82 includes a shaft bushing 83, which is welded as at 88 to a thrust plate 86**.

The second upper shaft 82 is supported by spacer member 60, which is welded to the second upper shaft 82 as at 84.

Toggle mechanism 46 includes first and second arms, 100 and 102, respectively. The upper end **100*a* of arm 100 is rotatably connected to central shaft 62, being welded to shaft bushing 63. Lower end 100*b* of first arm 100 is attached to a mounting bracket 104 by bolt and nut 106 and 108, respectively. Bracket 104 is attached to door 12 at 110**.

Upper end 102*a* of second arm 102 is also connected to mounting bracket 104 by bolt and nut 106 and 108, respectively. Lower end 102*b* of second arm 102 is connected to mounting bracket 112 by bolt and nut 114 and 116, respectively. Mounting bracket 112 is affixed to lower plate 42 of the underreamer housing 16.

Door 12 having an upper end 12*a* is supported by shaft 82 and is welded to shaft bushing 83 for rotation about shaft 82 when toggle mechanism 46 is actuated. Similarly, door 14 (not shown) is welded to the opposite shaft bushing (not shown) of shaft 72. Door 12 also includes a brace member 120 and an excavation cutting edge 122 extending the full length of door 12.

A cross member 124 is welded to shaft 72 as at 126 and to shaft 82 as at 128. Cross member 124 functions to prevent shafts 72 and 82 from becoming skewed when toggle mechanism 46 is actuated. Cross member 124 also constrains shafts 72 and 82 to identical vertical movement within their respective guideways 52 and 54.

Referring to FIG. 4, wherein like reference numerals are used for like and corresponding elements, underreamer door 12 is shown in its extended-operational position. Underreamer door 12 is movable from its retracted position as shown in FIG. 2 to its operative position as shown in FIG. 4 by operation of kelly bar assembly 20 moving downwardly into housing 16. Kelly bar assembly 20 is affixed to shaft 62, such that the downward movement of kelly bar assembly 20 causes arms 100 and 102 of toggle mechanism 46 to move toward each other in a scissorlike fashion causing underreamer door 12 to swing outwardly from housing 16 along the arcuate path 140 shown in FIG. 2 and the upper end 12*a* of door 12 to move downwardly. Simultaneous with the downward movement of shaft 62 within guideway 50, door 12 pivots about shaft 82, which moves downwardly within guideway 54. When door 12 is fully in its operative position, shaft 72 has moved from its initial position at 52*a* in guideway 52 to its lower position 52*b*, shaft 82 has moved from its initial position 54*a* within shaft 54 to its lower position 54*b* and shaft 62 has moved from its initial position 50*a* in guideway 50 to its lower position 50*b*. A similar toggle mechanism is associated with door 14, which causes door 14 to move downwardly and pivot about shaft 72 to its fully extended position as shown in FIG. 1.

Referring to FIG. 1, the principal advantage derived from the use of the present invention involves the fact that the toggle mechanism 46 substantially reduces the vertical height of underreamer assembly 10. The height of typical underreamers is indicated by the dimension Y, whereas the height of the underreamer assembly of the present invention is indicated by height X. The reduction in height of the present invention over the prior art is indicated by the variable H. Typically, an underreamer having a 60 inch diameter might have a 128 inch height. However, the present invention allows the vertical height of the underreamer to be reduced to approximately 102 inches, reducing the overall height, H, by more than 2 feet. Underreamer assembly 10 therefore, is advantageous in that it can be used where vertical obstructions exist.

From the foregoing it will be understood that the present invention comprises a toggle actuated underreamer including a vertically elongated housing having an upper and lower portion and a plurality of underreamer doors each including a toggle mechanism. The underreamer housing includes a plurality of upper shafts being retained in a plurality of guideways for slidable vertical movement therein and a central shaft retained in a central guideway for slidable vertical movement therein. Each of the underreamer doors includes a toggle machanism which includes a first and second arms, having first and second ends respectively. The first ends of the first and second arms are pivotally connected to each other and are centrally connected to the door by a common axis. The second end of the first arm is pivotally connected to the central shaft and the second end of the second arm is pivotally connected to the lower portion of the housing. The underreamer apparatus also includes a mechanism for actuating the underreamer doors to pivot the doors between a first retracted position within the housing and second position swung outwardly along an arcuate path thereof.

More specifically, one of the major advantages in the use of the present invention permits the use of an underreamer where typical prior art underreamers are inoperable due to vertical obstructions.

Although preferred embodiments of the invention have been illustrated in the Drawings, and described in the foregoing Detailed Description, it will be understood that the invention is not limited to the embodiments discussed, but is capable of rearrangement, modification and substitution of parts and elements without departing from the spirit of the invention.

What is claimed is:

1. An underreamer apparatus for belling out a portion of an underground hole into a conical configuration comprising:

a vertically elongated housing having an upper and lower portion;

a plurality of underreamer doors, each pivotally connected at the upper portion of the housing to an associated upper shaft within the housing;

each of the doors including a toggle mechanism wherein each toggle mechanism includes first and second arms, having first and second ends respectively, the first ends of said first and second arms being pivotally connected to each other and centrally to one of the doors by a common axis, the second end of the first arm being pivotally connected to a central shaft within the housing and the second end of the second arm being pivotally connected to the lower portion of the housing; and means for actuating the toggle means to pivot the doors between a first retracted position within the housing and a second position swung outwardly along an arcuate path thereof.

2. The underreamer apparatus of claim 1 and further including a plurality of guideways being parallel to one another and contained within the housing for retaining said shafts such that said shafts are vertically slidable therein.

3. The underreamer apparatus of claim 2 and further including a plurality of cross-members contained within the housing, slidably supported for vertical movement therein and connected across pairs of said upper shafts.

4. The underreamer apparatus of claim 3 wherein the means for actuating the doors comprises:

a kelly bar vertically slidable centrally within the housing for effecting rotation of the underreamer apparatus, for imparting a downwardly directed force to the central shaft, thereby causing each of the doors to swing outwardly to the second position, and for imparting an upwardly directed force to the central shaft causing each of the doors to swing inwardly to the first retracted position.

5. An underreamer apparatus for belling out a portion of an underground hole into a conical configuration comprising:

a vertically elongated housing having an upper and lower portion;

a plurality of guideways contained within the housing;

a plurality of upper shafts being retained in said plurality of guideways for slidable vertical movement therein;

a central guideway contained within the housing;

a central shaft being retained in said central guideway for slidable vertical movement therein;

each of the doors including first and second arms, having first and second ends respectively, the first end of said first and second arms being pivotally connected to each other and centrally to one of the doors by a common axis, the second end of the first arm being pivotally connected to the central shaft and the second end of the second arm being pivotally connected to the lower portion of the housing; and each of said plurality of underreamer doors connected at the upper portion of the housing to one of said plurality of upper shafts, the doors being movable between a first retracted position within the housing and a second position swung outwardly along an arcuate path thereof.

6. The underreamer apparatus of claim 5 and further including a plurality of cross-members contained within the housing, slidably supported for vertical movement therein and connected across pairs of said upper shafts.

7. The underreamer apparatus of claim 6 and further including means for actuating the doors between the first and second positions.

8. The underreamer apparatus of claim 7 wherein the means for actuating the doors comprises a kelly bar vertically slidable centrally within the housing for effecting rotation of the underreamer apparatus, for imparting a downwardly directed force to the central shaft thereby causing each of the doors to swing outwardly to the second position and for imparting an upwardly directed force to the central shaft causing each of the doors to swing inwardly to the first retracted position.

9. An underreamer apparatus for belling out a portion of an underground hole into a conical configuration comprising:

a vertically elongated housing having an upper and lower portion, including a first underreamer door;

first and second shafts contained within the housing and being retained in first and second guideways respectively, for slidable vertical movement therein;

a first arm having a first and second end, the first end being pivotally connected to a first end of the first shaft and the second end being pivotally connected centrally to the first door;

a second arm having a first and second end, the first end being pivotally connected to the second end of the first arm and centrally to the first door and the second end being pivotally connected to the lower portion of the housing;

said first door being pivotally connected at the upper portion of the housing to a first end of the second shaft and being movable between a first retracted position within the housing and second position swung outwardly along a first arcuate path thereof.

10. The underreamer apparatus of claim 9 and further including:

a second underreamer door;

a third shaft contained within the housing and being retained in a third guideway for slidable vertical movement therein;

a third arm having a first and second end, the first end being pivotally connected to a second end of the first shaft and a second end being pivotally connected centrally to the second door;

a fourth arm having a first and second end, the first end being pivotally connected to the second end of the third arm and centrally to the second door and the second end being pivotally connected to the lower portion of the housing;

said second door being pivotally connected at the upper portion of the housing to a first end of the third shaft and being movable between a first retracted position within the housing and a second position swung outwardly along a second arcuate path thereof.

11. The underreamer apparatus of claim 10 and further including means for actuating the first and second doors between the first and second positions.

12. The underreamer apparatus of claim 11 and further including:

a first cross-member contained within the housing and slidably supported for vertical movement therein, having a first end connected to the first end of the second shaft and a second end connected to the second end of the third shaft; and a second cross-member contained within the housing and slidably supported for vertical movement therein, having a first end connected to the first end of the third shaft and a second end connected to the second end of the second shaft.

13. The underreamer apparatus of claim 12 wherein the means for actuating the first and second doors comprises:

a kelly bar vertically slidable centrally within the housing for effecting rotation of the underreamer apparatus, for imparting a downwardly directed force to the first shaft thereby causing the first and second doors to swing outwardly along the first and second arcuate paths and for imparting an upwardly directed force to the first shaft causing the first and second doors to swing inwardly to the first retracted position.

* * * * *